US006357069B1

(12) United States Patent
Grandpierre et al.

(10) Patent No.: US 6,357,069 B1
(45) Date of Patent: Mar. 19, 2002

(54) METHOD AND BARRIER LAUNDRY INSTALLATION AND APPARATUS FOR SEALED TRANSFER OF LAUNDRY USEABLE IN SAID INSTALLATION

(75) Inventors: Cyril Grandpierre, Troyes; Charles Scardina, Laval, both of (FR)

(73) Assignee: Electrolux Systemes de Blanchisserie, Rosieres-pres-Troyes (FR)

( * ) Notice: Subject to any disclaimer, the term of this patent is extended or adjusted under 35 U.S.C. 154(b) by 0 days.

(21) Appl. No.: 09/419,966

(22) Filed: Oct. 18, 1999

(30) Foreign Application Priority Data

Oct. 29, 1998 (FR) ..... 98 13580

(51) Int. Cl.[7] ..... D06B 23/00
(52) U.S. Cl. ..... 8/158; 68/210
(58) Field of Search ..... 8/158, 159; 68/210, 68/140, 3 R; 134/113, 201; 55/385.2

(56) References Cited

U.S. PATENT DOCUMENTS

| | | | | |
|---|---|---|---|---|
| 3,577,752 | A | * | 5/1971 | Hertig et al. |
| 3,597,943 | A | * | 8/1971 | Gayring |
| 4,529,032 | A | * | 7/1985 | Molitor |
| 4,561,268 | A | * | 12/1985 | Southwick et al. |
| 4,642,828 | A | | 2/1987 | Lundberg |
| 5,003,794 | A | * | 4/1991 | Griffis |
| 5,329,659 | A | * | 7/1994 | Reinert, Sr. |
| 5,709,040 | A | * | 1/1998 | Horwitz |
| 6,035,671 | A | * | 3/2000 | Woods |
| 6,067,730 | A | * | 5/2000 | Woods |
| 6,082,149 | A | * | 7/2000 | Woods |
| 6,095,575 | A | * | 8/2000 | Woods |

FOREIGN PATENT DOCUMENTS

| | | | |
|---|---|---|---|
| DE | 2 522 116 | | 11/1976 |
| DE | 3240284 | * | 5/1984 |
| FR | 2 268 441 | | 11/1975 |
| GB | 1 481 579 | | 8/1977 |
| JP | 11-304208 | * | 5/1999 |

* cited by examiner

*Primary Examiner*—Frankie L. Stinson
(74) *Attorney, Agent, or Firm*—Pearne & Gordon LLP

(57) ABSTRACT

The present invention relates to a barrier laundry including a room (10) through which soiled laundry (16) enters and a clean room (12) separated from room (10) by a sealed barrier (14), an apparatus (19) is provided in barrier (14) for hermetically transferring the laundry. The apparatus (19) is used to introduce the soiled laundry (16) from the reception room (10) in leaktight bags (24) located in the clean room (12) without at any time breaking the leaktightness of the sealed barrier (14). The closed leaktight bags (24) full of laundry are routed into a washing machine (26) located in the clean room. The bags are designed to release the laundry at the start of the washing cycle.

24 Claims, 5 Drawing Sheets

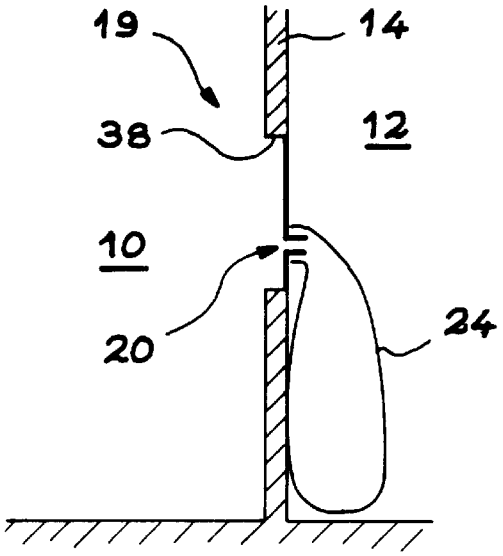
FIG. 6 A
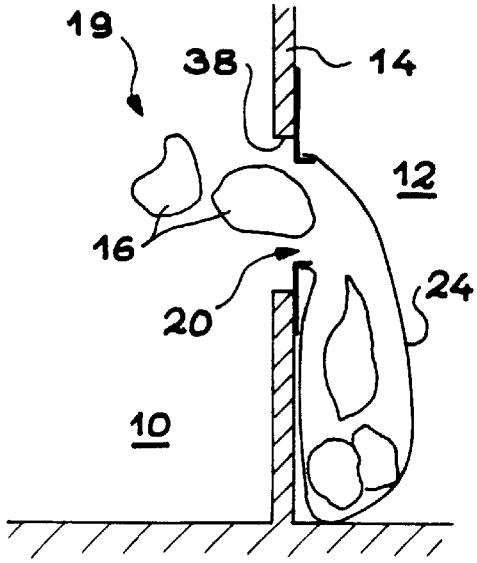
FIG. 6 B
FIG. 5
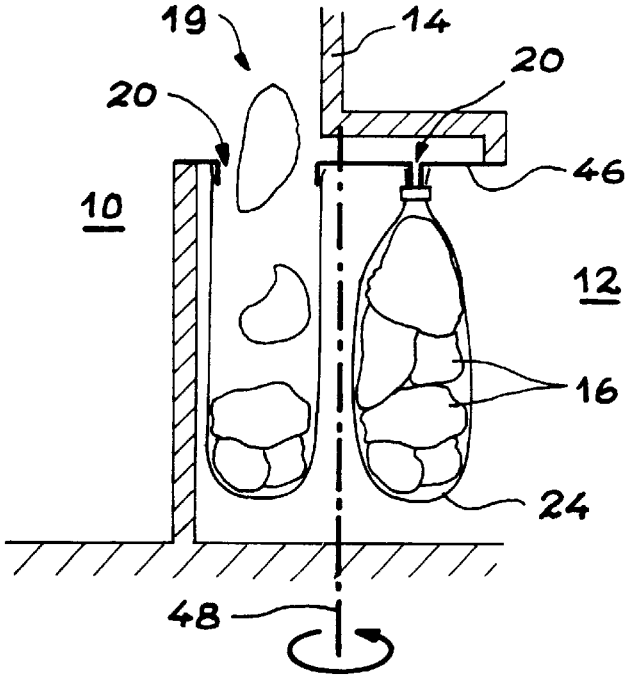

METHOD AND BARRIER LAUNDRY INSTALLATION AND APPARATUS FOR SEALED TRANSFER OF LAUNDRY USEABLE IN SAID INSTALLATION

FIELD OF THE INVENTION

The present invention relates to a laundry method that ensures that laundry remains aseptic or uncontaminated after washing.

The invention also relates to a barrier laundry installation for implementing the method.

The invention also relates to an apparatus for hermetically transferring the laundry that can be used in this type of barrier laundry installation.

The installation of the invention may be used in all situations where it is necessary to maintain the aseptic or non-contaminated status of laundry after washing. This situation is found particularly in hospitals, senior citizen accommodation, clean rooms, etc.

BACKGROUND ART

Laundries currently exist known as "barrier" laundries in which washed laundry remains uncontaminated due to a leaktight barrier that separates a reception room, through which the soiled laundry enters, from an aseptic or clean room through which the washed laundry leaves. Special washing machines are used in laundries of this type. These washing machines are built into the barrier that separates the two rooms and they comprise at least one door, that gives onto the reception room, used to insert the soiled laundry and at least one door, that gives onto the clean room, used to extract the washed laundry.

These existing laundries are effective at ensuring that laundry that has just been washed remains uncontaminated. However, they require the use of specially designed washing machines that cost considerably more than standard machines with a single-door.

In order to overcome the drawback of these existing washing machines the present invention replaces the special two-door washing machines with ordinary single-door washing machines. These ordinary single-door washing machines are fitted in the barrier so as to be mobile, such that the single door of the washing machine may alternate between two positions: that in the reception room and that in the clean room. The washing machine may either be mounted on a revolving platform or onto a plate mounted on rails in order for the washing machine to be mobile.

In all cases, due to the mobility of the washing machine between the loading and unloading positions causes some of the outer surfaces of the washing machine to be subject to at least partial contamination in the clean room when the laundry is removed. The washed laundry can only remain uncontaminated providing the outer surfaces of the washing machine are at least partially decontaminated before the washing machine door changes position to be in the clean room. This over complicates installation and considerably lengthens operating time.

DISCLOSURE OF THE INVENTION

The invention relates to a method and the installation of a barrier laundry, enabling standard design single-door washing machines to be used that maintain washed laundry uncontaminated, that do not require any decontamination operations and that do not complicate handling procedures.

According to the invention, this is achieved by means of a barrier laundry process in which soiled laundry enters a reception room, is washed in at least one washing machine, and in which the washed laundry is then unloaded in an clean room. The clean room is separated from the reception room by a leaktight barrier. The process is characterized in that it comprises the following stages:

- the soiled laundry is passed in at least one bag from the reception room to the clean room through at least one sealable opening provided in the barrier onto which the rim of the bag is hermetically connected, said bag being capable of opening automatically in the washing machine;
- the opening and said bag are closed and said bag is disconnected from said opening;
- the bag containing the soiled laundry is put into the washing machine, said washing machine being entirely installed in the clean room; and
- the washing machine is set into operation such that it opens the bag and then washes the laundry contained in said bag.

This process may be implemented either by using bags that comprise at least one water-soluble component or by using bags that are capable of opening due to the mechanical action of the washing machine. In the first example, the bags can be closed using soluble ties, comprise a precut section that is closed using a soluble part; alternatively the bags may be totally soluble.

In a preferred embodiment of the invention the rim of the bag is connected to a distortable frame that surrounds the inside of said sealable opening. At least one section of the circumference of the distortable frame is then fastened to a flexible section of the barrier. This flexible section enables the frame to vary between a closed position when no bag is connected to the frame and an open position that enables laundry to be put into the bag.

Advantageously, when the sealable opening is in the closed position the rim of the bag is connected to a frame comprising four rigid sections. The ends of these sections are hinged together to constitute a distortable quadrilateral frame that is capable of folding in on itself.

Preferably, the rim of the bag can be connected to the distortable frame by said rim being gripped against the outer surface of the frame.

The direction of the distortable frame may be more or less vertical, horizontal or sloped, according to requirements.

If the frame is sloped at least two distortable frames may be assembled onto the same revolving loader that is built into the barrier.

According to one improvement on the invention the bag containing soiled laundry is weighed before it is disconnected from the opening.

According to another improvement on the invention the bag is closed using heat welding.

The invention also relates to a barrier laundry that comprises a reception room and a clean room that are separated by a leaktight barrier as well as at least one washing machine, the laundry being characterized in that it also comprises:

- means for hermetically transferring the washing, said means being fitted into the barrier and including at least one sealable opening;
- bags that are capable of opening automatically in the washing machine;
- means for connecting a rim of one of the bags to a rim of the sealable opening in the clean room, such that the connection is leaktight;
- the washing machine being totally installed in the clean room and being capable of receiving at least one full bag of laundry and of washing said laundry once the bag opens.

The invention also relates to a device for hermetically transferring soiled laundry through a barrier that separates a reception room from a clean room, the device being characterized in that it comprises at least one distortable frame that surrounds a sealable opening and that, in the clean room, is provided with means for connecting a rim of one the bags that is capable of opening automatically in a washing machine in the clean room, said connection being leaktight.

BRIEF DESCRIPTION OF THE DRAWINGS

Various embodiments of the invention will now be described, as non-limitative examples, referring to the attached drawings in which:

FIG. 4 shows the means used to connect a leaktight bag to the sealable opening of these transfer means;

FIG. 5 is a similar view to that of FIG. 2B and is a schematic representation of a version of the first embodiment of the invention;

FIGS. 6A and 6B are similar views to those of FIGS. 2A and 2B and are schematic representations of a second embodiment of the invention.

DETAILED DESCRIPTION OF PREFERRED EMBODIMENTS OF THE INVENTION

Figure 1:
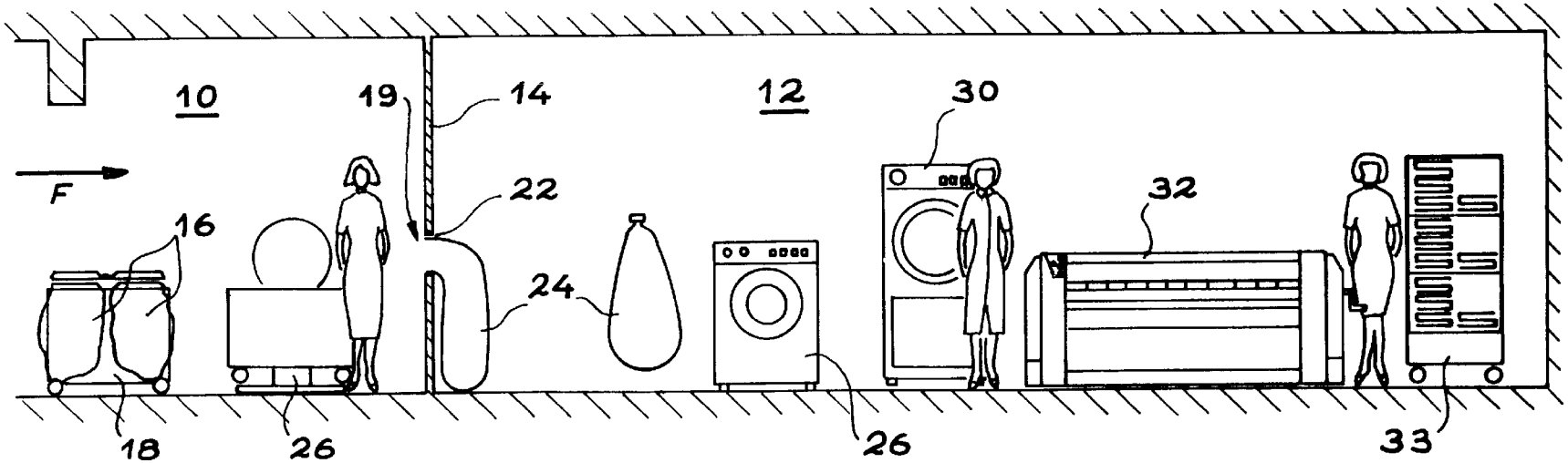
FIG. 1 is a schematic representation of a barrier laundry implementing the method of the invention.

FIG. 1 is a very schematic representation of a barrier laundry implementing the laundry method according to the invention.

As in existing barrier laundries, a laundry of this kind comprises a contaminated reception room 10 and an aseptic or clean exit room 12 that is separated from the reception room 10 by a leaktight barrier 14 that creates a wall. Generally the barrier 14 is rigid and more or less vertical.

The reception room 10 has free access to the outside via one or more openings as schematically shown by arrow F to the left of FIG. 1. Any soiled or contaminated laundry 16 can, therefore, be brought into this reception room 10, for example using trolleys 18 or any other suitable means of conveyance.

Figure 2A:
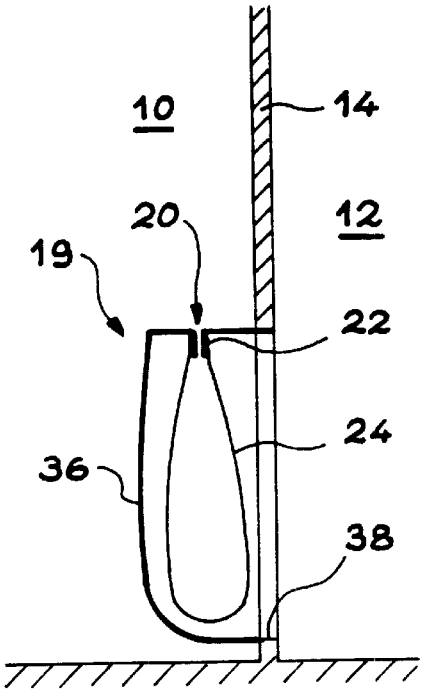
FIGS. 2A to 2D are larger scale views showing schematic representations of the various stages of transferring soiled laundry. The soiled laundry is in a bag located in the clean room and is transferred through the leaktight barrier according to a first embodiment of the invention.

According to the invention, means 19 for hermetically transferring the soiled laundry are built into the leaktight barrier 14. In the embodiment shown, means 19 for hermetically transferring the soiled laundry comprise a single sealable opening 20 (FIG. 2A). Furthermore, means 22 are provided to connect the rim of the opening of a bag 24 to the rim of this sealable opening 20, such that the connection is leaktight. More precisely, bag 24 is positioned in the clean room 12 and it is designed to open automatically using any means after being put into a washing machine 26 that is totally installed in clean room 12.

In order to achieve this, bags 24 are used that are made of flexible plastic. At least one part of the bag is water soluble or is designed such that it automatically breaks due to the mechanical action of the washing machine once the bag has been closed and the machine is set into operation.

In the first example bags 24 can have a precut section that is temporarily closed by a soluble part. They can thus be closed using a soluble tie or at least a part can be manufactured in a soluble material.

In general any bag 24 may be used that maintains the soiled laundry inside the bag until the washing machine 26 has been closed and that automatically releases the laundry in the washing machine immediately after the door has been closed, in other words at the beginning of the washing cycle.

Initially, the sealable opening 20 is closed, as schematically represented in FIG. 2A. In clean room 12 the rim of opening 20 is connected to the rim of the opening of one of the flexible leaktight bags 24 using leaktight connection means 22. This connection is made as leaktight as possible.

Figure 2B:
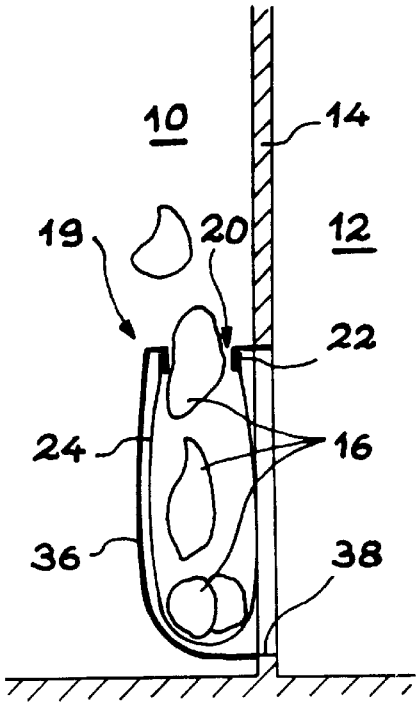

When the laundry 16 has been brought into the reception room 10 to be washed the sealable opening 20 is opened, as schematically shown in FIG. 2B, in order for a load of laundry to be put into bag 24 connected to this opening. This load of laundry can be previously weighed using scales 28 installed in the reception room 10 (FIG. 1). The laundry can also be weighed using a weighing device (not shown) that is directly connected to the sealable opening 20.

The laundry load that is put into bag 24 is generally equal to the maximum capacity of the washing machine 26. However, the load may also be less than maximum capacity, such as half maximum capacity. If the laundry only weighs half maximum capacity two or more bags 24 filled with soiled laundry can be put into washing machine 26 and washed together.

Figure 2C:
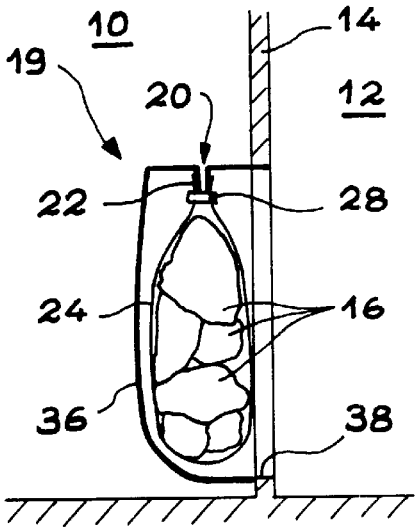

When the laundry weighing the ideal weight has been put into bag 24 sealable opening 20 is closed, as schematically shown in FIG. 2C, and the flexible bag 24 is also closed, for example using a tie 28. This tie 28 can also be a flexible tie as mentioned above.

In another version bag 24 can be hermetically sealed using any means and particularly heat welding. In this event heat welding means (not shown) are associated with means 19 for hermetically transferring the laundry, said means being located at the sealable opening 20.

Figure 2D:
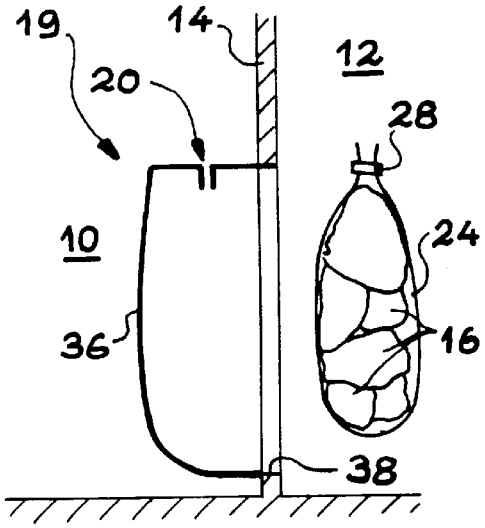

When sealable opening 20 and bag 24 have been hermetically sealed the leaktight connecting means 22 are actuated such that the rim of the opening is disconnected from the rim of sealable opening 20. Bag 24, filled with soiled laundry 16, can then be transferred to washing machine 26 or one of washing machines 26 installed in clean room 12, as schematically shown in FIG. 2D. A traditionally designed single-door washing machine may be used given that washing machine 26 (or washing machines 26) is/are completely located in inside room 12, as shown schematically in FIG. 1.

As mentioned above, the bag (or bags) 24 contained in the washing machine open automatically when the washing machine is closed and as soon as it begins the washing or decontamination cycle. All washing is thus performed in the uncontaminated zone.

When the cycle ends the laundry can undergo a variety of standard additional operations, such as drying, ironing and folding, in machines shown by numbers 30 and 32 in FIG. 1. The clean, folded laundry is then preferably packaged before it leaves the clean room 12, for example on a trolley 33, through a chamber (not shown) that ensures the room remains uncontaminated.

Figure 3A:
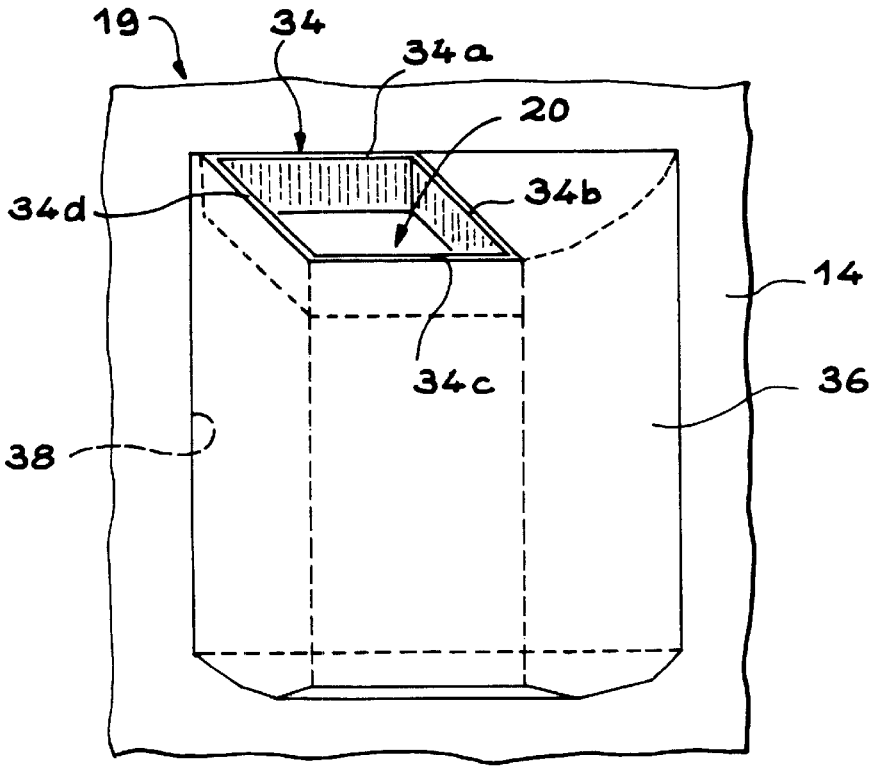
FIGS. 3A and 3B are perspective views of the laundry transport means that are built in to the leaktight barrier, respectively in the open and closed position.
Figure 3B:
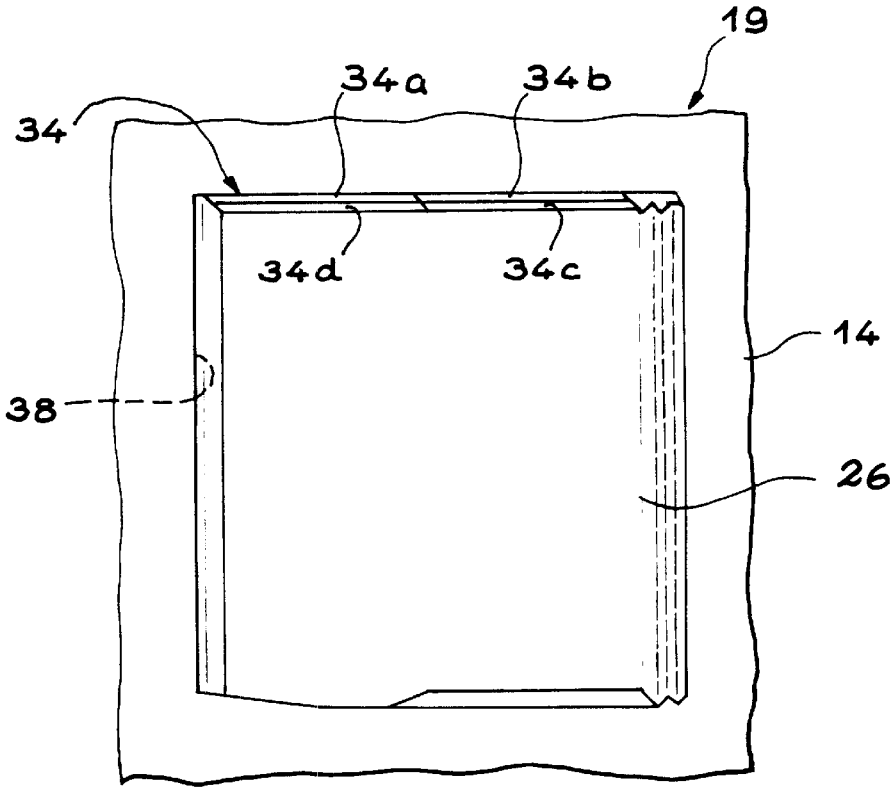
Figure 4:
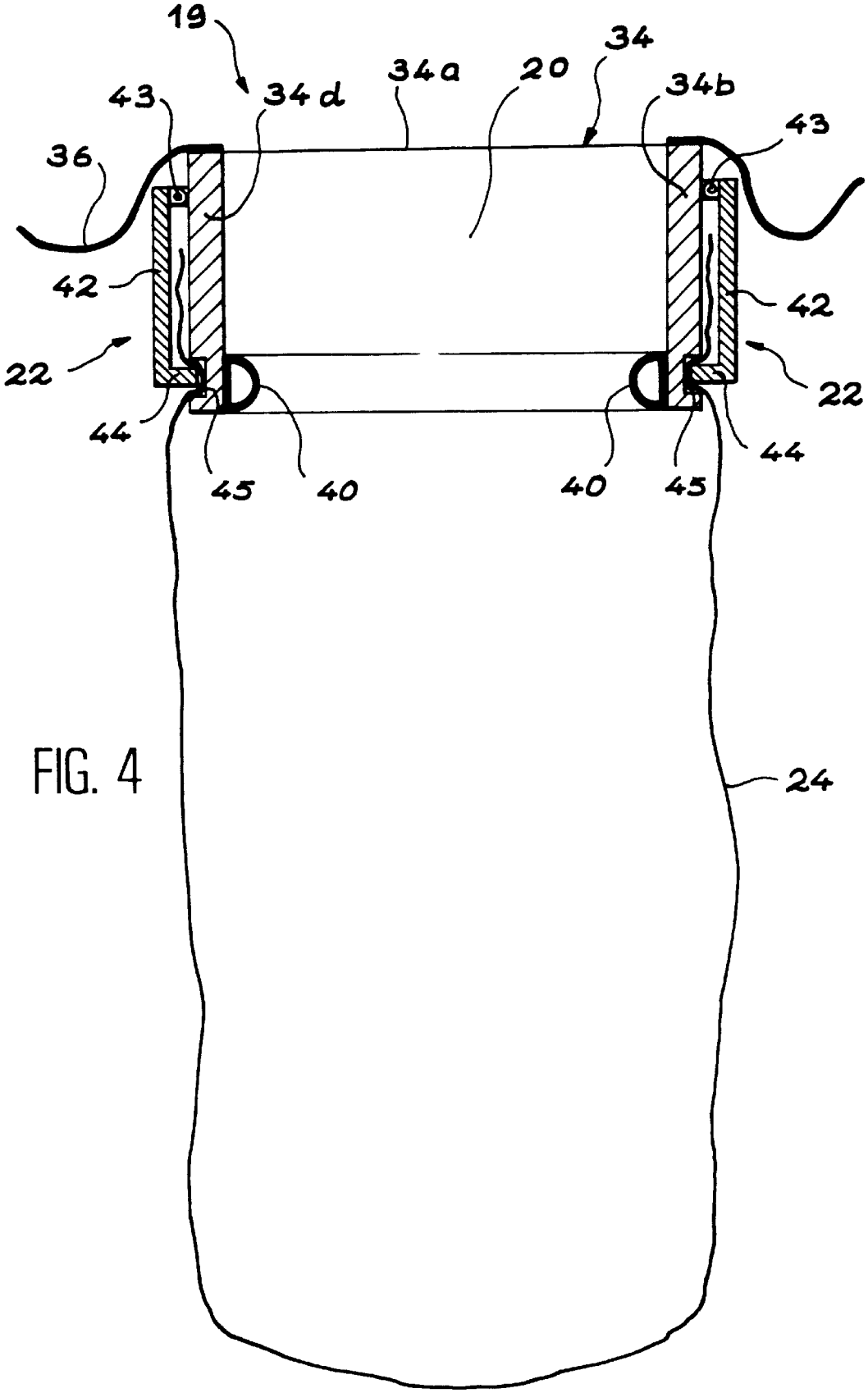
FIG. 4 is a larger scale cross section of the of the transfer means of FIGS. 3A and 3B.

In the first embodiment of the invention, shown in greater detail in FIGS. 3A, 3B and 4, sealable opening 20 is contained within a distortable frame 34. Besides, a section of the circumference of this distortable frame $$$20$$$ is hermetically fastened to a flexible section 36 of leaktight barrier 14. This flexible section 36 is made of a flexible material that is leaktight and has a high degree of mechanical resistance, such as leaktight or rigid, distortable canvas. Therefore, the distortable frame $$$24$$$ and the flexible section 36 of the barrier constitute means 19 for hermetically transferring laundry.

More precisely, in this configuration the distortable frame 34 is located in more or less horizontal plane, such that it projects towards reception room 10 in relation to vertical barrier 14. In another version, the distortable frame could also be located in a downward-sloping plane in relation to the horizontal line in the reception room 10 to facilitate loading laundry.

In the example shown, distortable frame 34 frame comprises four rigid sections 34*a*, 34*b*, 34*c* and 34*d*. The ends of these sections are hinged together to constitute a distortable quadrilateral frame that is capable of opening, as shown in FIG. 3A, or completely folded in on itself, as shown in FIG. 3B. FIG. 3B shows the sealable opening 20 in the closed position. As a non-limitative example, the four sections that constitute frame 34 can be of equal length. Opening 20 is then approximately rectangular or square shaped when the frame is completely open.

Segment 34*a* of distortable frame 34 is directly fastened to the upper rim of a window 38 (drawings 2A and 2D) that is built into leaktight barrier 14. In order to ensure that barrier 14 remains hermetically sealed when opening 20 is in the closed position, the rims of flexible section 36 of barrier 14 are hermetically fastened to the three remaining segments 34*b*, 34*c* and 34*d* of distortable frame 34 and to the rims of window 38.

The measurements of window 38, which is, for example, rectangular, are designed to enable bag 24 to be loaded into the machine when the bag is filled with laundry and to enable the distortable frame 34 to fold against the rigid section of the barrier in the closed configuration shown in FIG. 3B. Therefore, the window 38 extends downwards and over at least one of the sides of segment 34a of frame 34.

As shown in FIG. 4, at least two segments of frame 34 are fitted with leaktight seals 40 on the inner surfaces facing opening 20 and on the lower sections. These seals come to bear on the segment facing the seals, and create a leaktight seal when the distortable frame is completely folded, as shown in FIG. 3B. Leaktightness between parts 10 and 12 (FIG. 1) is thus effectively maintained when no laundry is transferred.

FIG. 4 also shows a particular embodiment of means 22 used to hermetically connect the rim of the opening of bag 24 with frame 34 that surrounds sealable opening 20. In this example, means 22 comprise parts 42 that are hinged on the outer surfaces of the various segments of distortable frame 34. More precisely, these parts 42 are hinged onto 43 in the upper sections of the segments of the frame. The lower sections of parts 42 comprise projections 44 that are capable of gripping the rim of the opening of bag 24 in grooves 45 that are provided opposite in the segments of frame 34. The rim may be gripped by torsion springs (not shown) associated with hinges 43 and that continually draw parts 42 towards the segments of frame 34.

FIG. 5 is a schematic representation of a version of the first embodiment of the invention.

In this example, means 19 for hermetically transferring laundry comprise a more or less horizontal revolving loader 46. This loader 46 comprises at least two sealable openings 20 that are surrounded, for example, by distortable frames (not shown). Loader 46 is capable of revolving around a more or less vertical axis 48. The loader uses, for example, revolving seals (not shown) to operate in leaktight conjunction with lower and upper rigid sections of barrier 14 in order to maintain the leaktightness of said barrier. Furthermore, loader 46 includes flexible sections (not shown) that are used to distort the frames surrounding openings 20, as described above.

Barrier 14, that includes revolving loader 46, is constructed such that at least one opening 20 is accessible from the reception room 10 in every stop position of the loader 46. A first bag 24, connected to this first opening 20, can then be filled with soiled laundry. At the same time another bag 24, previously filled with soiled laundry 16, is accessible from clean room 12 and can be transferred to a washing machine. The construction of the barrier therefore enables the rate at which soiled laundry is transferred through the leaktight barrier to be increased without the leaktightness of the barrier being broken at any time.

In a second embodiment of the invention, schematically represented in FIGS. 6A and 6B, means 19 for hermetically transferring laundry are such that sealable opening 20 is created directly in the more or less vertical plane of leaktight barrier 14.

In this example, a distortable frame may be used that is identical to frame 34 described above but that is provided in a more or less vertical plane of the barrier. The flexible section of the barrier is then also located approximately in this vertical plane. The only function of window 38, that is built into barrier 14, is then to enable the frame to become distorted between the unfolded and the completed folded positions. Bag 24 is then directly hung in clean room 12, as shown in FIGS. 5A and 5B.

Other alternative layouts are clearly possible within the scope of the invention. In particular, the following operations may be partly or fully automatic: transfer of the laundry in bags, opening and closing of sealable opening 20, hooking the bags and closing the bags.

What is claimed is:

1. Barrier laundry method wherein soiled laundry is introduced into a reception room where it is washed in at least one washing machine the washed laundry is removed from the machine in a clean room, the method being characterized in that it comprises the following stages:

the soiled laundry is passed in at least one bag from the reception room to the clean room through at least one sealable opening provided in the barrier and onto which the rim of the bag is connected such that it is leaktight, said bag being capable of opening automatically in the washing machine;

the opening and said bag are closed and the bag is disconnected from said opening;

the bag containing the soiled laundry is put into the washing machine, said washing machine being entirely installed in the clean room; and the washing machine is set into operation such that it opens the bag and then washes the laundry contained in said bag.

2. Method of claim 1 wherein the bag used includes at least one water-soluble component.

3. Method of claim 1 wherein the bag used is capable of opening due to the mechanical action of the washing machine.

4. Method of claim 1 wherein the rim of the bag is connected to a distortable frame that surrounds the inside of said sealable opening by said rim being gripped against the outer surface of the frame.

5. Method of claim 1 wherein the bag containing soiled laundry is weighed before it is disconnected from the opening (20).

6. Method of claim 1 wherein the bag is closed using heat welding.

7. Barrier laundry comprising a reception room and a clean room separated by a sealed barrier together with at least one washing machine, said laundry characterized in that it also comprises:

means for hermetically transferring the washing, said means being fitted into the barrier and including at least one sealable opening;

bags that are capable of opening automatically in the washing machine;

means for connecting a rim of one the bags to a rim of the sealable opening in the clean room, such that the connection is leaktight;

the washing machine being totally installed in the clean room and capable of receiving at least one full bag of laundry to wash said laundry once the bag opens.

8. Laundry of claim 7 wherein at least one component of each bag is water-soluble.

9. Laundry of claim 7 wherein the bags are capable of opening automatically due to the mechanical action of the washing machine (26).

10. Laundry of claim 7 wherein hermetic transfer means comprise at least one distortable frame surrounding the sealable opening and bearing said means for connecting the bags, together with a flexible section of leaktight barrier to which at least part of the distortable frame is connected so that the frame enables the sealable opening to distort between a closed position and an open position.

11. Laundry of claim 10 wherein the distortable frame comprises four rigid sections the ends of which are hinged together to constitute a distortable quadrilateral frame that is capable of folding in on itself in the said closed position of the sealable opening.

12. Laundry of claim 10 wherein the distortable frame is more or less vertical.

13. Laundry of claim 10 wherein the distortable frame is more or less horizontal or sloped.

14. Laundry of claim 13 wherein hermetic transfer means comprise a revolving loader on which at least two distortable frames are mounted.

15. Laundry of claim 7 wherein the means for connecting the bags are gripping means.

16. Laundry of claim 7 wherein the means for weighing the bags full of laundry are associated with means for hermetically transferring the laundry.

17. Laundry of claim 7 wherein the means for sealing the bags by heat welding means are associated with means for hermetically transferring the laundry.

18. Apparatus for transferring soiled laundry through a sealed barrier separating a reception room from a clean room, characterized in that it comprises at least one distortable frame surrounding a sealable opening and comprising means in the clean room for hermetically connecting the rim of a bag capable of opening automatically in a washing machine located in the clean room.

19. Apparatus of claim 18 also comprising a flexible section of leaktight barrier onto which is fastened at least one section of distortable frame so that it can distort between a closed position and an open position of the sealable opening.

20. Apparatus of claim 18 wherein the distortable frame comprises four rigid sections, the ends of which are hinged together to constitute a distortable quadrilateral frame that is capable of folding in on itself in the said closed state of the sealable opening.

21. Apparatus of claim 18 wherein the means for connecting the bags are gripping means.

22. Apparatus of claim 18 comprising a revolving loader on which at least two distortable frames are mounted.

23. Apparatus of claim 18 comprising means for weighing the bags filled with laundry.

24. Apparatus of claim 18 comprising means for closing bag using heat welding.

* * * * *

UNITED STATES PATENT AND TRADEMARK OFFICE

CERTIFICATE OF CORRECTION

PATENT NO. : 6,357,069 B1
DATED : March 19, 2002
INVENTOR(S) : Grandpierre et al.

It is certified that error appears in the above-identified patent and that said Letters Patent is hereby corrected as shown below:

Column 6,
Line 43, please delete "machine the" and insert therefor -- machine. The --.

Signed and Sealed this

Eighteenth Day of June, 2002

*Attest:*

*Attesting Officer*

JAMES E. ROGAN
*Director of the United States Patent and Trademark Office*